US006217196B1

(12) United States Patent
Kosich et al.

(10) Patent No.: US 6,217,196 B1
(45) **Date of Patent: *Apr. 17, 2001**

(54) STROBE LIGHT SYSTEM

(75) Inventors: Joseph Kosich, Toms River, NJ (US); Luy Nguyen, Ocean, NJ (US); David H. Strome, Newtown, PA (US)

(73) Assignee: Wheelock, Inc., Long Branch, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/045,428

(22) Filed: Mar. 20, 1998

(51) Int. Cl.[7] ..... F21V 7/00

(52) U.S. Cl. ..... 362/297; 362/518; 362/302; 362/346

(58) Field of Search ..... 362/302, 518, 362/297, 298, 346, 347, 350, 360, 361; 340/331

(56) References Cited

U.S. PATENT DOCUMENTS 5,347,259 9/1994 Jongewaard ..... 340/331
5,363,293 * 11/1994 Lasker ..... 362/302
5,475,361 * 12/1995 Curran et al. ..... 340/331

* cited by examiner

*Primary Examiner*—Sandra O'Shea
*Assistant Examiner*—Bertrand Zeade
(74) *Attorney, Agent, or Firm*—Thomason, Moser & Patterson, LLP; Kin Wah Tong

(57) ABSTRACT

A small and non-intrusive reflector is disclosed for use with a strobe light system for enhancing light distribution for wall mounted application, while maintaining a low current draw. The reflector comprises a "top reflective section" and a "bottom reflective section", where each reflective section comprises three distinct reflective portions: a left reflective portion, a center reflective portion and a right reflective portion. Collectively, top section left portion and bottom section left portion provide illumination to a negative horizontal range of viewing angles, whereas top section right portion and bottom section right portion provide illumination to a positive horizontal range of viewing angles. Finally, the top section center portion and bottom section center portion provide illumination to a range of horizontal and vertical viewing angles.

23 Claims, 12 Drawing Sheets

C-C

D-D

E-E

F-F

G-G

H-H

I-I

J-J

K-K

L-L

M-M

STROBE LIGHT SYSTEM

The invention generally relates to a strobe light system. More particularly, the invention is a strobe warning light system that incorporates a unique reflector that enhances light distribution for wall mounted application.

BACKGROUND OF THE DISCLOSURE

Strobe lights have been widely employed in warning systems such as fire warning systems, security systems and the like. In fact, regulations and standards, e.g., from the Underwriters Laboratories (UL), have been established to define various requirements, e.g., strobe frequency and light output.

One important requirement is the light output, which can be satisfied by increasing the intensity of the strobe lamp or by incorporating additional strobe lamps, as necessary. Unfortunately, warning systems are typically operated by battery sources, where an increase in the light output of the strobe lamp or the quantity of strobe lamps will reduce the operating time of the warning systems.

To address this criticality, unique reflectors have been implemented to redirect the light output of the strobe lamp to enhance light distribution without the need to increase the overall light output of the strobe lamp. For example, U.S. Pat. No. 5,347,259 issued on Sept. 13, 1994 and U.S. Pat. No. 5,475,361 issued on Dec. 12, 1995, which are owned by the assignee and herein incorporated by reference, illustrate reflectors that provide enhanced light outputs. Although these reflectors provide excellent performance when mounted to a ceiling, the light outputs from these reflectors are not maximized when mounted to a wall.

Therefore, a need exists in the art for a strobe light system that incorporates a small non-intrusive reflector for enhancing light distribution for wall mounted application, while maintaining a low current draw.

SUMMARY OF THE INVENTION

The present invention is a small non-intrusive reflector that is employed within a strobe light system for enhancing light distribution for wall mounted application, while maintaining a low current draw. More specifically, the present reflector comprises a base that is co-planar with respect to a first reference plane.

In the preferred embodiment, a "top reflective section", relative to the strobe lamp axis, e.g., when the reflector is mounted against a wall, curves upwardly from the first reference plane. The top reflective section comprises three distinct reflective portions, a left reflective portion, a center reflective portion and a right reflective portion.

Similarly, a "bottom reflective section", relative to the strobe lamp axis, e.g., when the reflector is mounted against a wall, curves upwardly from the first reference plane. The bottom reflective section also comprises three distinct reflective portions, a left reflective portion, a center reflective portion and a right reflective portion.

Collectively, top section left portion and bottom section left portion provide illumination within the horizontal viewing angles of −60° to −90°, whereas top section right portion and bottom section right portion provide illumination within the horizontal viewing angles of 60° to 90°. Finally, the top section center portion and bottom section center portion provide illumination within the vertical viewing angles of 0° to −70°, and 0° to −15°, respectively. Furthermore, the top section center portion and bottom section center portion also provide illumination within the horizontal viewing angles of −60° to 60°.

These various portions contain panels that are uniquely designed with curvatures to direct light at various vertical and horizontal angles, without having to increase current draw. Furthermore, the present reflector meets the UL requirements while maintaining a small and non-intrusive structural configuration.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1:
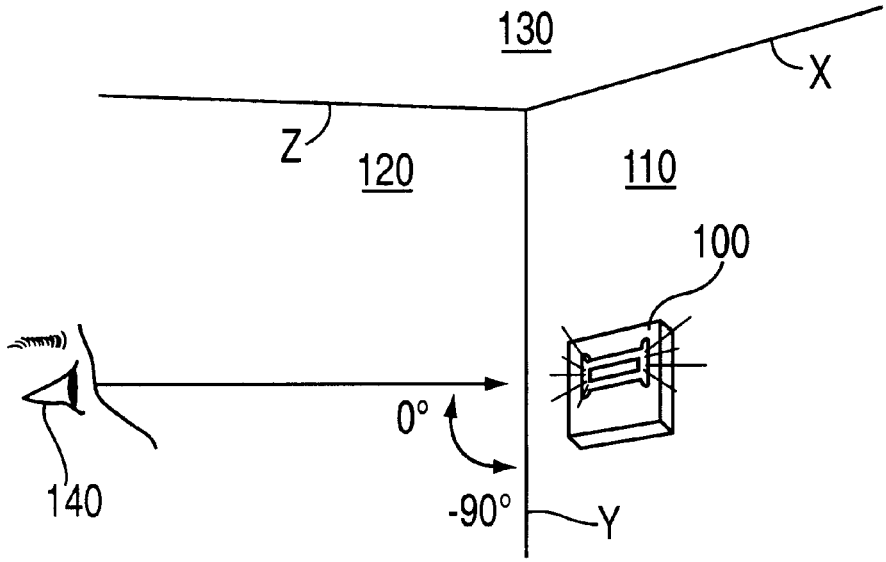
FIG. 1 depicts a pictorial diagram of a strobe light system of the present invention in a wall mounted application with respect to a vertical viewing plane.

FIG. 1 depicts a pictorial diagram of a strobe light system 100 of the present invention in a wall mounted application. The strobe light system 100 is mounted against a wall or a plane 110 that is defined by the x-y axes (first reference plane). Two other perpendicular planes 120 (second reference plane) and 130 (third reference plane) are defined by the y-z axes and the x-z axes, respectively. It should be understood that these reference planes are provided for the purpose of disclosing the present invention and, as such, should not be taken as limitations as to the configuration of the present invention.

The UL requirements for wall-mounted strobe warning lights prescribe that the light from the strobe lamp must be directed into a region defined by a vertical reference plane and a horizontal reference plane intersecting along a line that is coincident with the lamp axis. For example, FIG. 1 illustrates a viewer 140 who is facing the strobe light system 100 with respect to a "vertical viewing angle" (vertical plane). When the viewer is looking straight into the strobe lamp, i.e., the axis of the strobe lamp, the vertical viewing angle is defined to be zero degree (0°). The vertical viewing angle can be decreased down to (−90°), if the viewer is directly below the strobe lamp and looking upwardly.

Figure 2:
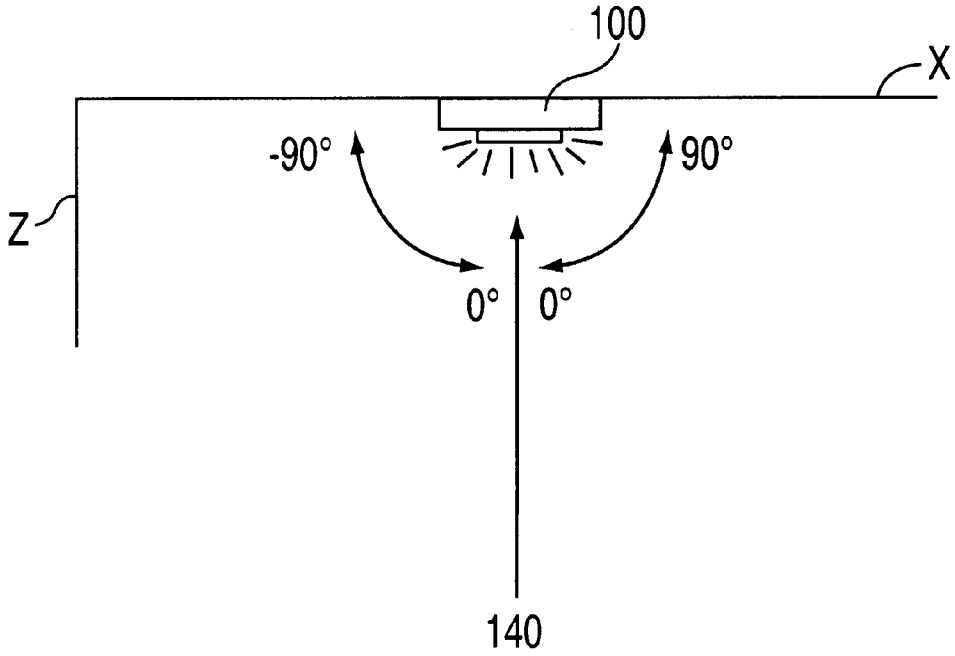
FIG. 2 depicts a pictorial diagram of a strobe light system of the present invention in a wall mounted application with respect to a horizontal viewing plane.

Similarly, FIG. 2 also illustrates a viewer 140, who is facing the strobe light system 100 with respect to a "horizontal viewing angle" (horizontal plane). When the viewer is looking straight into the strobe lamp, i.e., the axis 600 (shown in FIG. 6) of the strobe lamp, the horizontal viewing angle is defined to be zero degree (0°). The horizontal viewing angle can be decreased down to (−90°), if the viewer is directly left of the strobe lamp. Conversely, the horizontal viewing angle can be increased up to (90°), if the viewer is directly right of the strobe lamp.

It should be understood that these reference angles and their signs are provided for the purpose of disclosing the present invention and, as such, should not be taken as limitations as to the configuration of the present invention. More importantly, the UL requirements contain a listing of vertical and horizontal viewing angles and their associated minimum light output at each of these viewing angles in five degree intervals (as shown in tables 1 and 2 below).

In order to meet the UL requirements, the present invention incorporates a unique reflector. Namely, the present reflector contains a configuration of oriented reflective surfaces that collectively enhance light distribution for wall mounted application to meet the UL requirements as shown in tables 1 and 2 below.

TABLE 1

| Vertical Plane | | |
|---|---|---|
| Angle | UL Requirement (cd) | Present Reflector (cd) |
| −90 | 1.8 | 3 |
| −85 | 1.8 | 7 |
| −80 | 1.8 | 8 |
| −75 | 2.0 | 8 |
| −70 | 2.3 | 8 |
| −65 | 2.4 | 8 |
| −60 | 2.7 | 8 |
| −55 | 3.3 | 8 |
| −50 | 4.0 | 9 |
| −45 | 5.1 | 9 |
| −40 | 6.9 | 13 |
| −35 | 9.8 | 22 |
| −30 | 13.5 | 23 |
| −25 | 13.5 | 21 |
| −20 | 13.5 | 24 |
| −15 | 13.5 | 24 |
| −10 | 13.5 | 24 |
| −5 | 13.5 | 24 |
| 0 | 15.0 | 24 |

TABLE 2

| Horizontal Plane | | |
|---|---|---|
| Angle | UL Requirement (cd) | Present Reflector (cd) |
| −90 | 3.8 | 6 |
| −85 | 3.8 | 7 |
| −80 | 4.5 | 8 |
| −75 | 4.5 | 13 |
| −70 | 5.3 | 17 |
| −65 | 5.3 | 13 |
| −60 | 6.0 | 11 |
| −55 | 6.8 | 12 |
| −50 | 8.3 | 18 |
| −45 | 11.3 | 18 |
| −40 | 11.3 | 14 |
| −35 | 11.3 | 20 |
| −30 | 11.3 | 21 |
| −25 | 13.5 | 23 |
| −20 | 13.5 | 23 |
| −15 | 13.5 | 24 |
| −10 | 13.5 | 24 |
| −5 | 13.5 | 24 |
| 0 | 15.0 | 24 |
| 5 | 13.5 | 24 |
| 10 | 13.5 | 24 |
| 15 | 13.5 | 24 |

TABLE 2-continued

| Horizontal Plane | | |
|---|---|---|
| Angle | UL Requirement (cd) | Present Reflector (cd) |
| 20 | 13.5 | 23 |
| 25 | 13.5 | 23 |
| 30 | 11.3 | 21 |
| 35 | 11.3 | 20 |
| 40 | 11.3 | 14 |
| 45 | 11.3 | 18 |
| 50 | 8.3 | 18 |
| 55 | 6.8 | 12 |
| 60 | 6.0 | 11 |
| 65 | 5.3 | 13 |
| 70 | 5.3 | 17 |
| 75 | 4.5 | 13 |
| 80 | 4.5 | 8 |
| 85 | 3.8 | 7 |
| 90 | 3.8 | 6 |

FIGS. 3–6 illustrate the reflector 300 of the present invention, where FIGS. 3, 4, 5, 6 illustrate a top view, a side view, a cut-away view and an isometric view, respectively. Since the reflector 300 comprises a plurality of reflective surfaces, the reader should refer to these figures simultaneously as the present reflector is disclosed.

Figure 3:
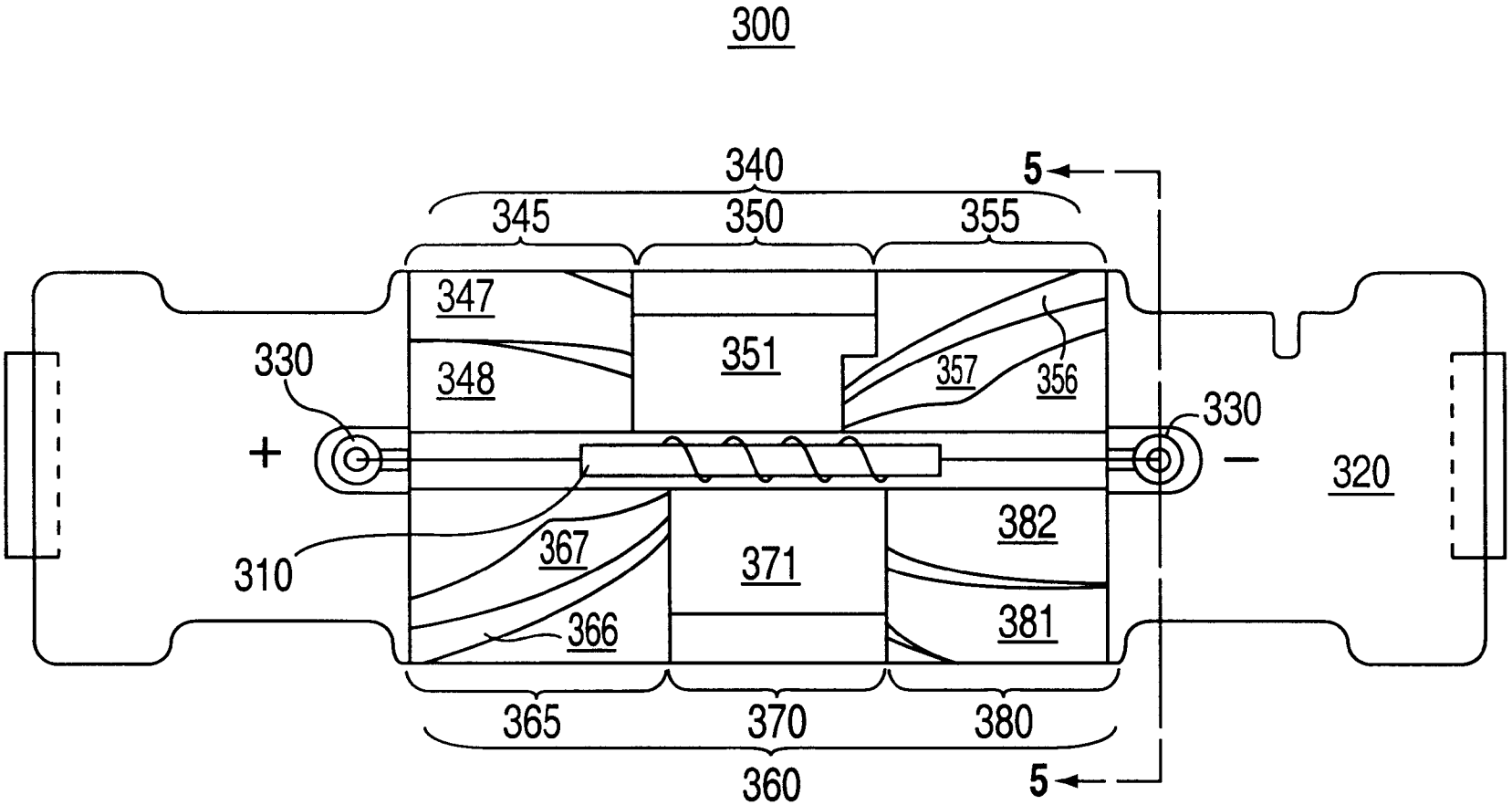
FIG. 3 depicts a top view of the reflector of the present invention.

More specifically, the reflector 300 comprises a base portion 320, reflective sections 340 and 360 and a pair of supports 330. FIG. 3 also illustrates a strobe lamp 310 (light emitting element), e.g., from EG & G Heimann with part number AGA1015, which is mounted onto the supports 330 of the reflector 300. The supports 330 are, in turn, coupled to a mounting plate and/or circuit board (not shown) of a strobe light system. The circuit board provides the necessary circuitry to activate the strobe lamp at a particular frequency to produce a predefined light output. A lens (not shown) is typically installed over the strobe lamp 310.

The supports 330 can be attached to the strobe light system via screws, lugs or snap-on fittings. Each of the supports 330 is injection-molded from a suitable material, e.g., from GE Lexan™ and contains an aperture and a post that receives and supports an electrode lead of the strobe lamp 310.

In the preferred embodiment, the reflective sections 340 and 360 and the pair of supports 330 are molded onto the base portion 320. However, it should be understood that these various portions can be implemented as separate parts that are suitably coupled together. In fact, the present reflective sections 340 and 360 can be implemented with other base and support structural configurations. The base can be broadly defined as a member for supporting the present reflective sections 340 and 360.

Figure 6:
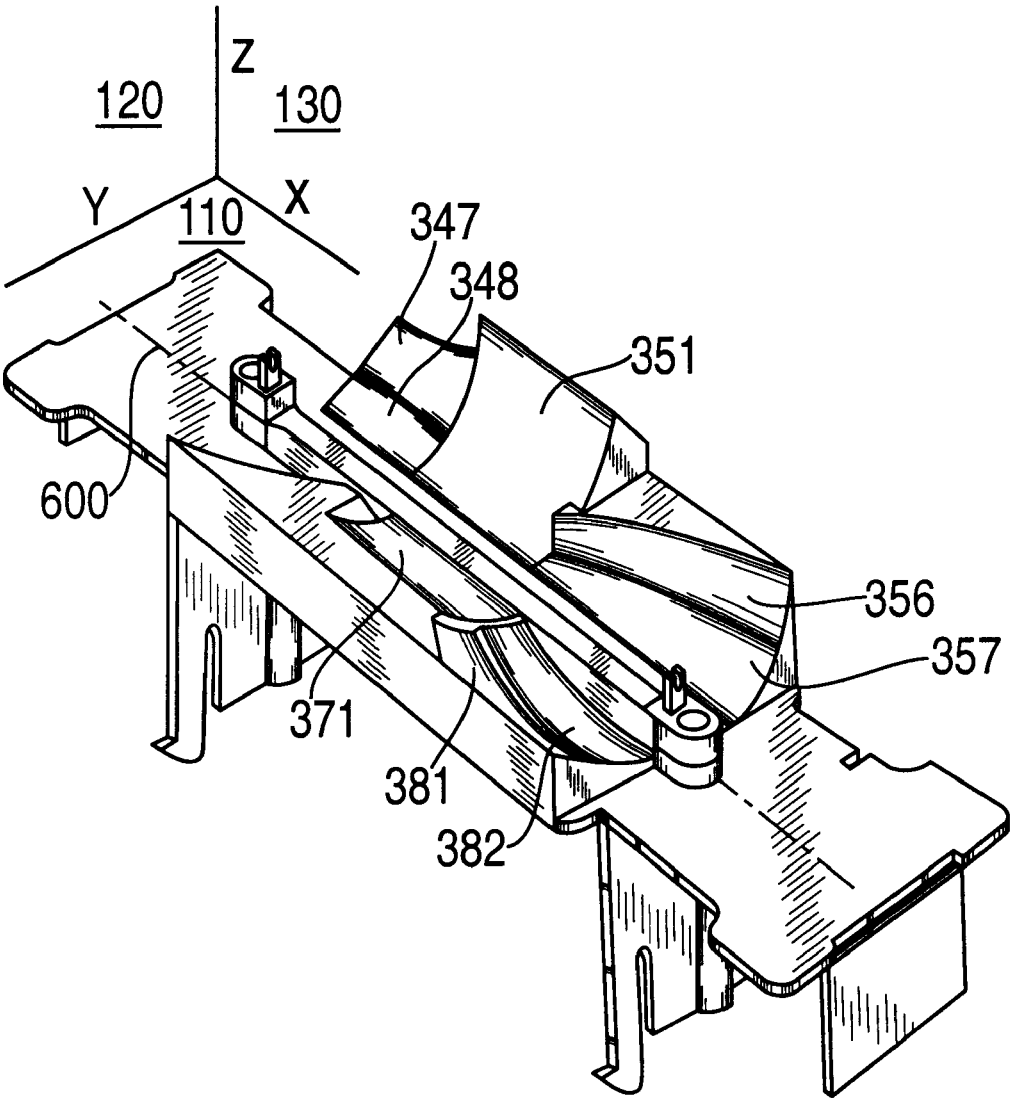
FIG. 6 depicts an isometric view of the reflector of the present invention.

Referring to FIG. 6, reflector 300 is illustrated isometrically with respect to the reference planes 110, 120, and 130, as defined above in FIG. 1. The base 320 of the reflector is approximately 3.5 inches by one inch in length and width and is co-planar with respect to the x-y plane (first reference plane) 110. Referring to FIG. 3, in the preferred embodiment, a "top reflective section" 340, relative to the strobe lamp axis 600, e.g., when the reflector is mounted against a wall, curves upwardly from the x-y plane (first reference plane) 110. The top reflective section 340 comprises three distinct reflective portions: a left reflective portion 345, a center reflective portion 350 and a right reflective portion 355.

Similarly, in the preferred embodiment, a "bottom reflective section" 360, relative to the strobe lamp axis 600, e.g., when the reflector is mounted against a wall, curves upwardly from the x-y plane (first reference plane) 110. The bottom reflective section 360 also comprises three distinct reflective portions: a left reflective portion 365, a center reflective portion 370 and a right reflective portion 380.

The left reflective portions 345 and 365 collectively direct light toward the left side of the reflector 300, e.g., roughly between the range of horizontal viewing angles −60° to −90°. More specifically, the strobe lamp 310 in combination with the top and bottom center reflective portions is capable of providing acceptable light intensity within the range of horizontal viewing angles 0° to −60°. However, at more acute horizontal viewing angles, the strobe lamp 310 and the pair of center reflective portions 350 and 370, are not capable of providing sufficient light intensity.

As such, reflector 300 incorporates a top section left reflective portion 345 that comprises an upper curve panel 347 and a lower curve panel 348. Similarly, the bottom section left reflective portion 365 comprises an upper curve panel 367 and a lower curve panel 366. In operation, upper curve panel 347 has a curvature that provides illumination at the range of horizontal viewing angles −60° to −70°. Next, both lower curve panel 348 and upper curve panel 367 have curvatures that provide illumination at the range of horizontal viewing angles −70° to −80°. Finally, lower curve panel 366 has a curvature that provides illumination at the range of horizontal viewing angles −80° to −90°.

Similarly, the right portions 355 and 380 collectively direct light toward the right side of the reflector 300, e.g., roughly between the range of horizontal viewing angles 60° to 90°. Again, the strobe lamp 310 in combination with the top and bottom center reflective portions is capable of providing acceptable light intensity within the range of horizontal viewing angles 0° to 60°. However, at more acute viewing angles, the strobe lamp 310, and the pair of center reflective portions 350 and 370, are not capable of providing sufficient light intensity.

As such, reflector 300 incorporates a top section right portion 355 that comprises an upper curve panel 356 and a lower curve panel 357. Similarly, the bottom section right portion 380 comprises an upper curve panel 382 and a lower curve panel 381. In operation, lower curve panel 381 has a curvature that provides illumination at the range of horizontal viewing angles 60° to 70°. Next, both upper curve panel 382 and lower curve panel 357 have curvatures that provide illumination at the range of horizontal viewing angles 70° to 80°. Finally, upper curve panel 356 has a curvature that provides illumination at the range of horizontal viewing angles 80° to 90°.

It should be noted that in the preferred embodiment the top section right portion 385 is diagonally symmetrical with bottom section left portion 365. Similarly, top section left portion 345 is diagonally symmetrical with bottom section right portion 380.

However, it should be understood that the present invention can be modified by switching top section left portion 345 with bottom section left 365 portion. This exchange should result in a reflector having the top section left portion and top section right portion be made symmetrical along an axis that is perpendicular to the strobe lamp axis 600. In turn, the bottom section right portion and the bottom section left portion is also made to be symmetrical along an axis that is perpendicular to the strobe lamp axis 600.

Figure 4:
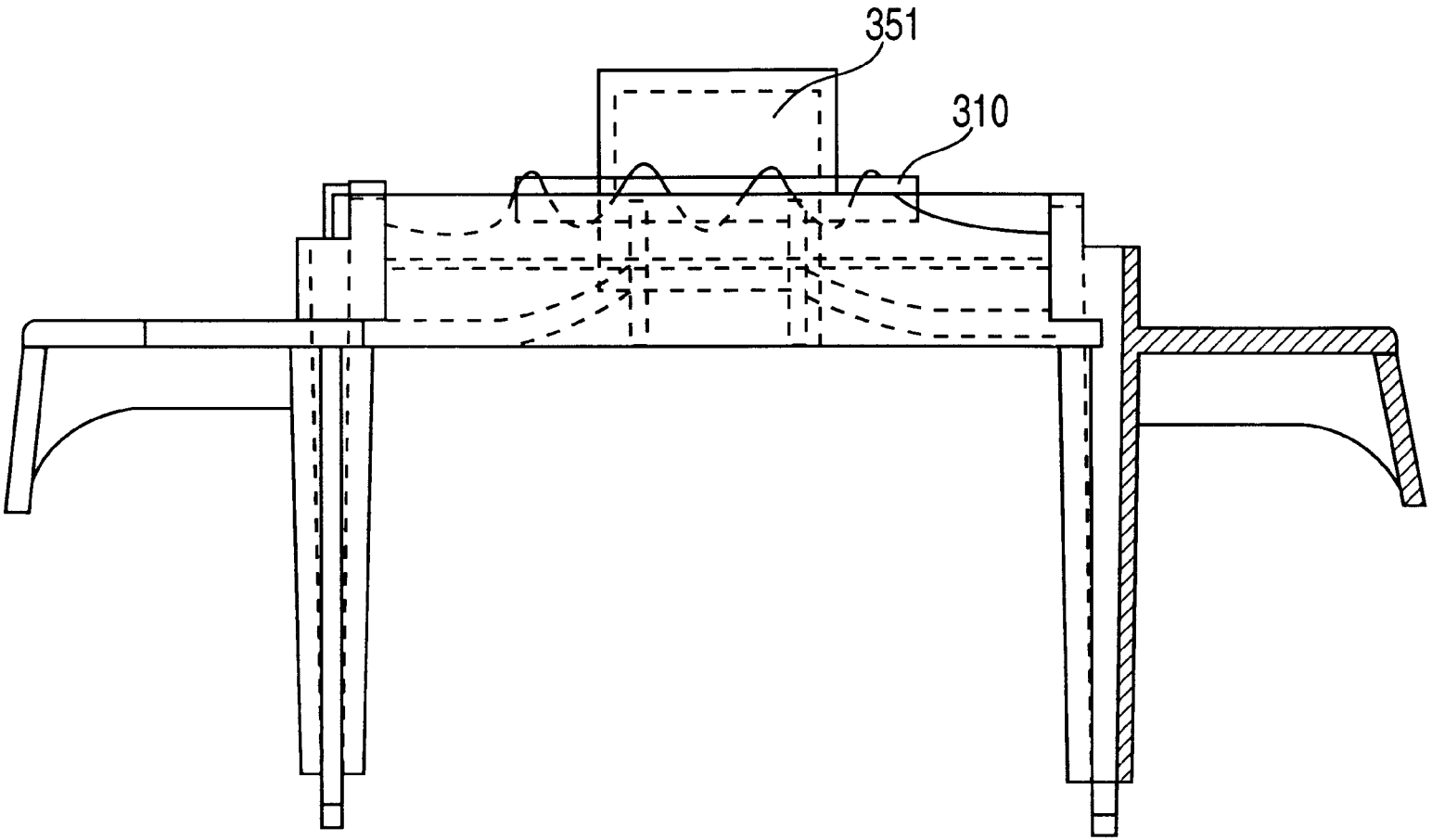
FIG. 4 depicts a side view of the reflector of the present invention.
Figure 5:
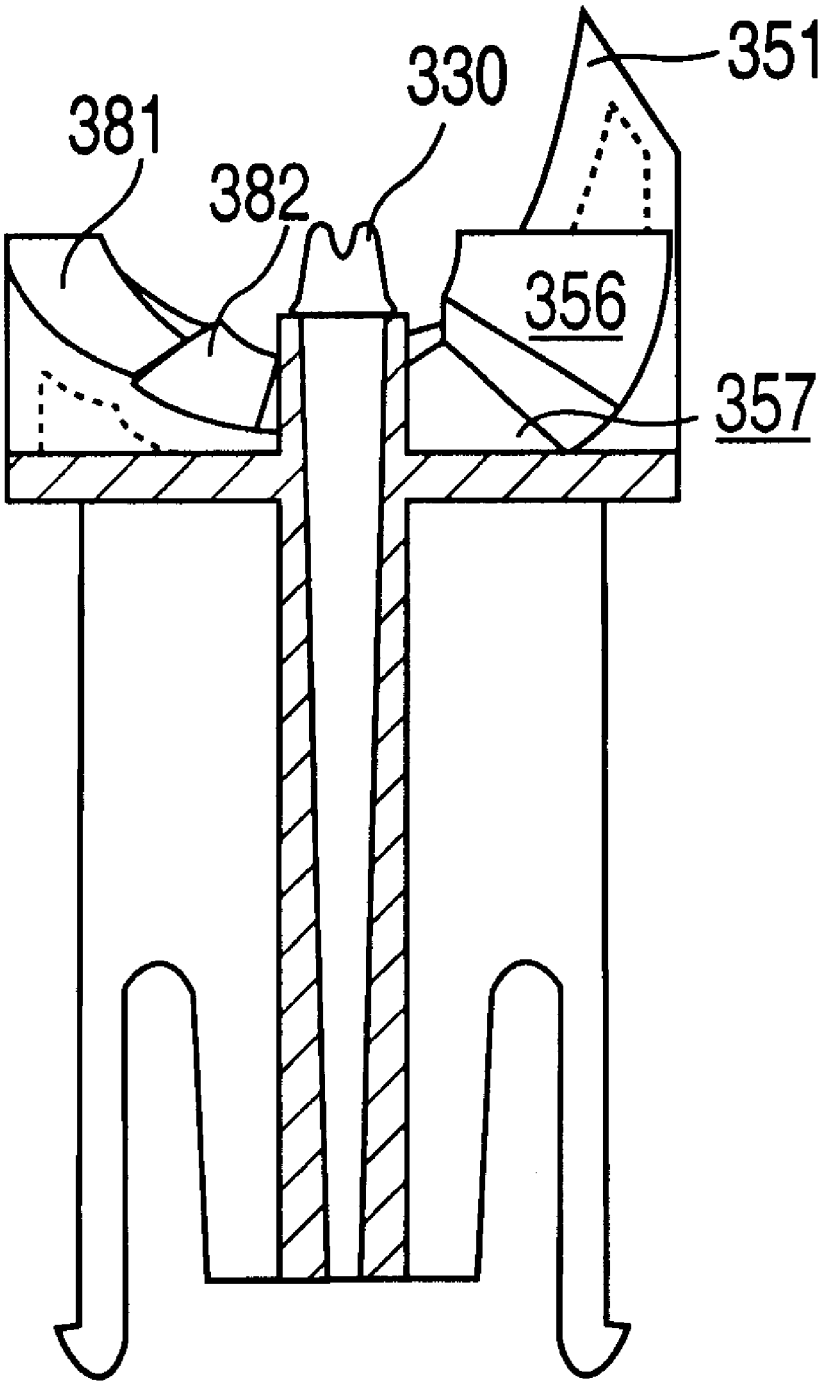
FIG. 5 depicts a cut away view of the reflector of the present invention, along line 5—5 of FIG. 3.

The reflector 300 incorporates a top section center portion 350 having an extended panel 351. More specifically, extended panel 351 curves upwardly from the x–y plane (first reference plane) 110 to a height that is above the strobe lamp 310 as shown in FIGS. 4–6. One purpose of this extended panel 351 is to provide additional illumination at horizontal viewing angles −60° to 60°. Another purpose of this extended panel 351 is to provide additional illumination at vertical viewing angles 00° to −70°. Since the reflector 300 is designed for wall mounted application, the height of the extended panel 351 poses little problem, since there is no illumination requirement above the vertical viewing angle 0°.

More specifically, the strobe lamp 310 itself is not capable of providing acceptable light intensity within the range of vertical viewing angles 0° to −70°. However, at more acute vertical viewing angles, the strobe lamp 310, by itself, is capable of providing sufficient light intensity, due to the lower UL requirement at these angles (See Table 1). As such, extended panel 351 has a curvature that provides illumination at the range of vertical viewing angles 0° to −70°.

Finally, the reflector 300 incorporates a bottom section center portion 370 having a panel 371. More specifically, panel 371 curves upwardly from the x-y plane (first reference plane) 110 to a height that is slightly below the center of the strobe lamp 310 as shown in FIGS. 4–6. One purpose of this extended panel 371 is to provide additional illumination at horizontal viewing angles −60° to 60°. Another purpose of this extended panel 371 is to provide additional illumination at vertical viewing angles 0° to −15°. Since the reflector 300 is designed for wall mounted application, the height of the panel 371 is not extended above the strobe lamp 310 as in the extended panel 351, so that it does not interfere with light from strobe lamp at −90° vertical viewing angle.

Figure 7:
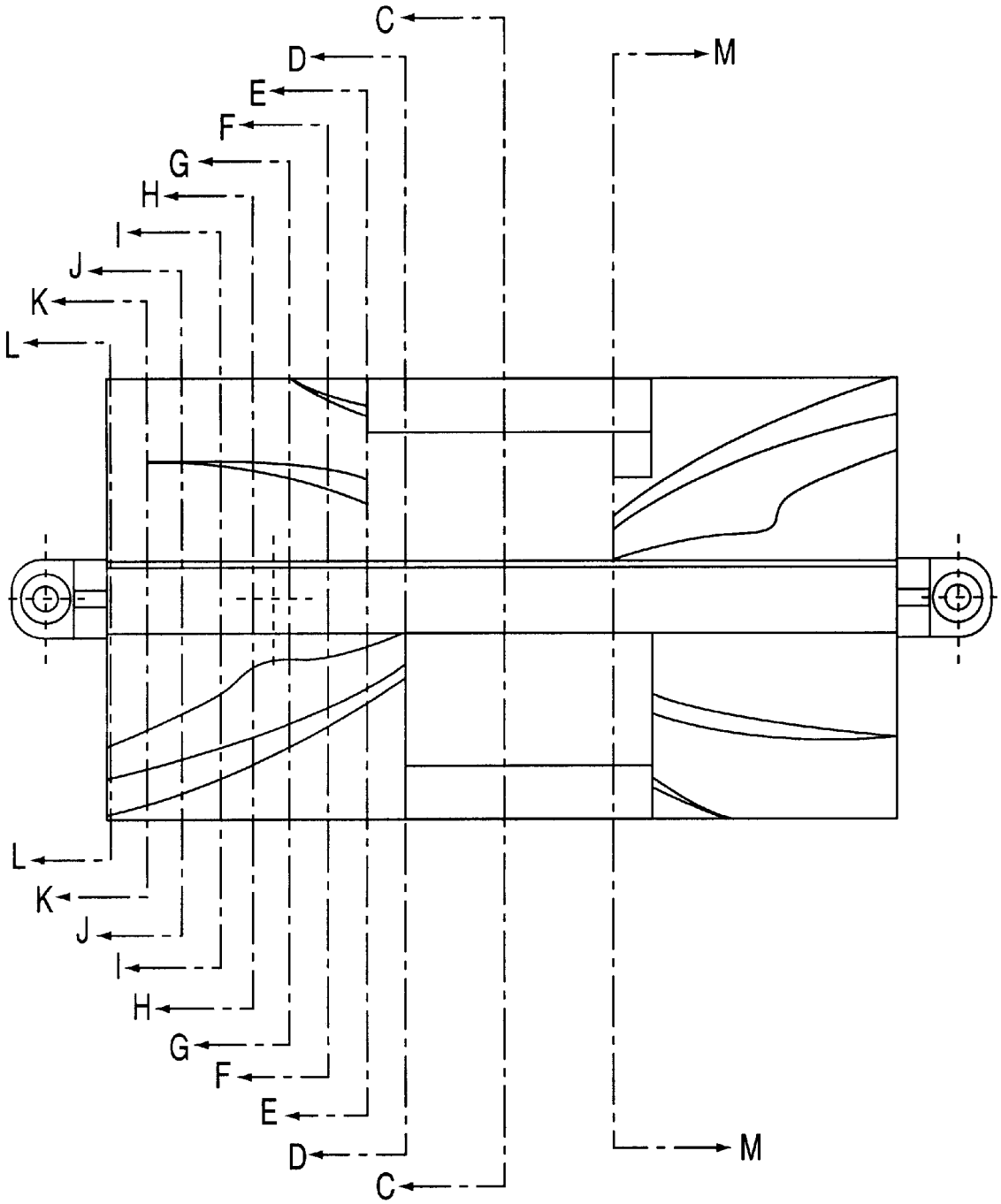
FIG. 7 is a fragmentary plan view of the reflective portions of the reflector.
Figure 7A:
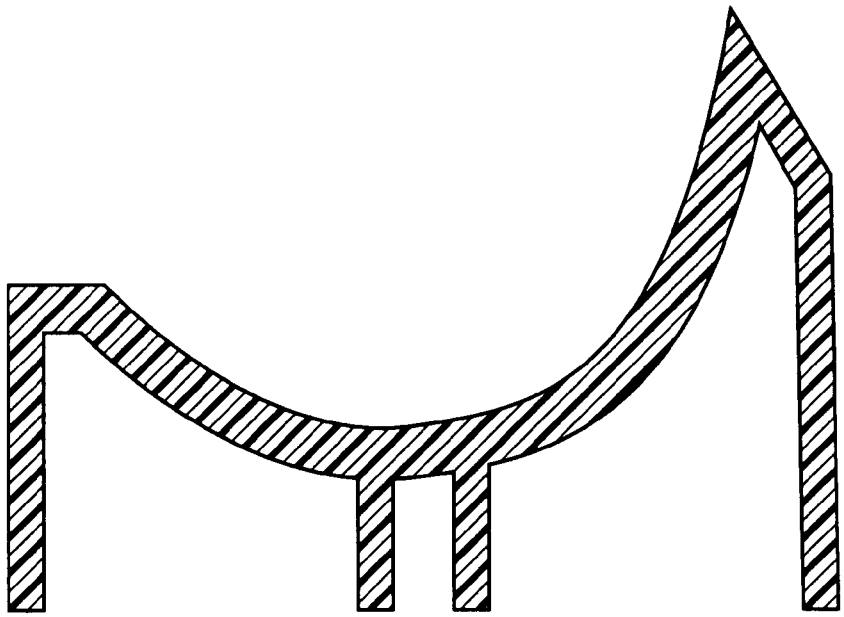
FIGS. 7A–7K are cross-sectional views taken along the corresponding lettered lines of FIG. 7.
Figure 7B:
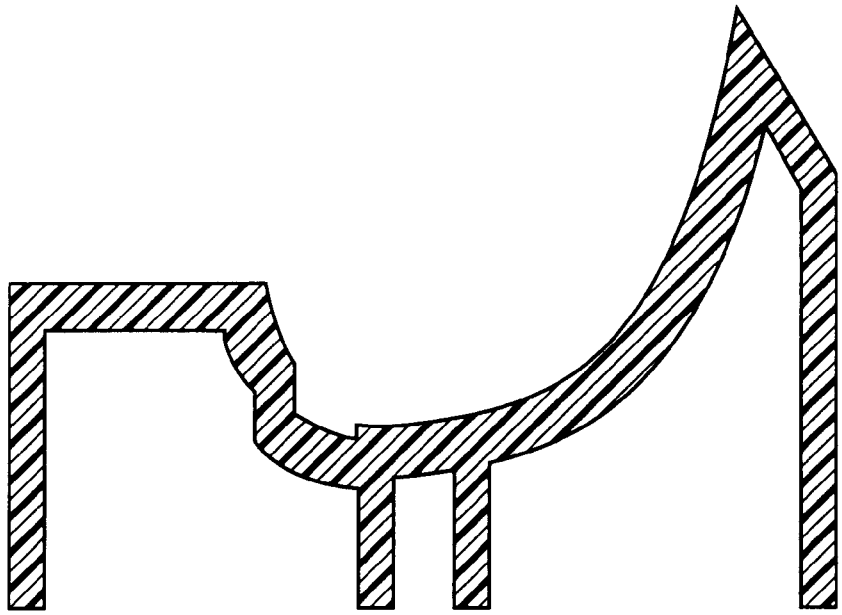
Figure 7C:
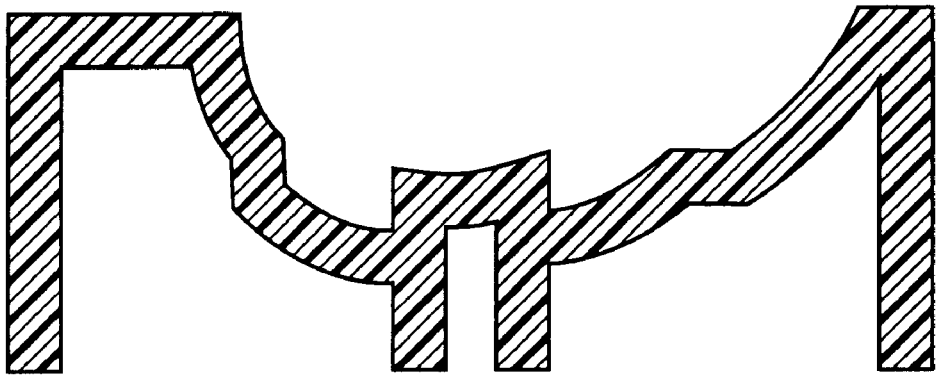
Figure 7D:
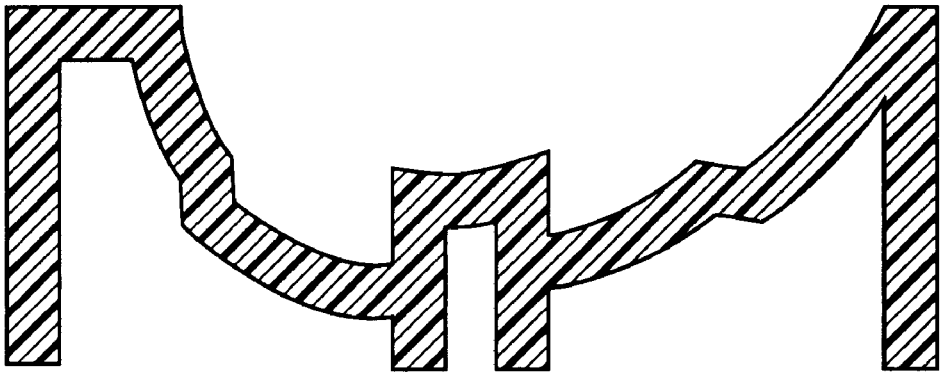
Figure 7E:
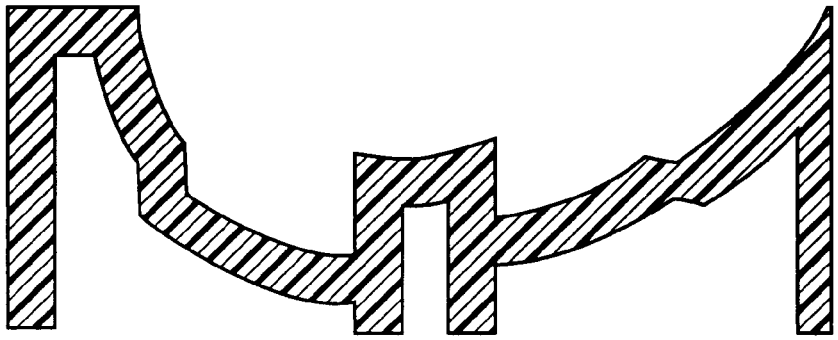
Figure 7F:
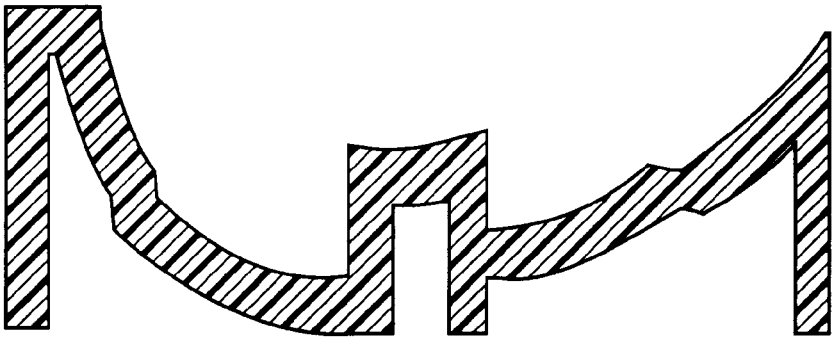
Figure 7G:
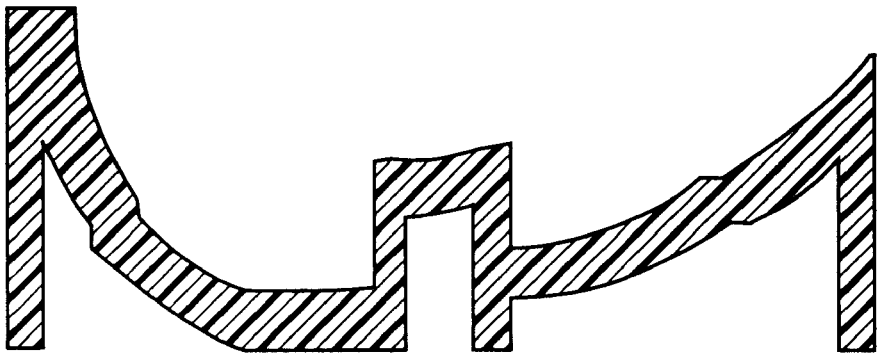
Figure 7H:
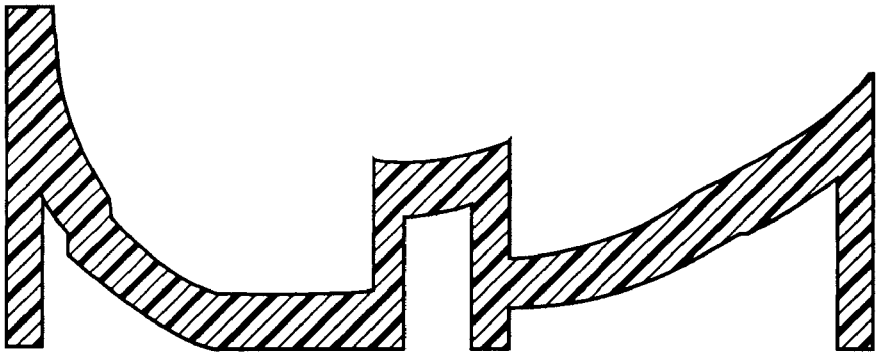
Figure 7I:
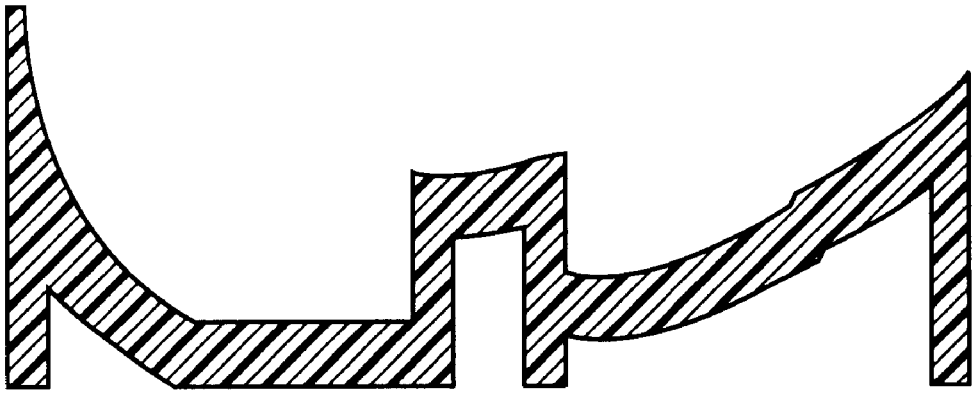
Figure 7J:
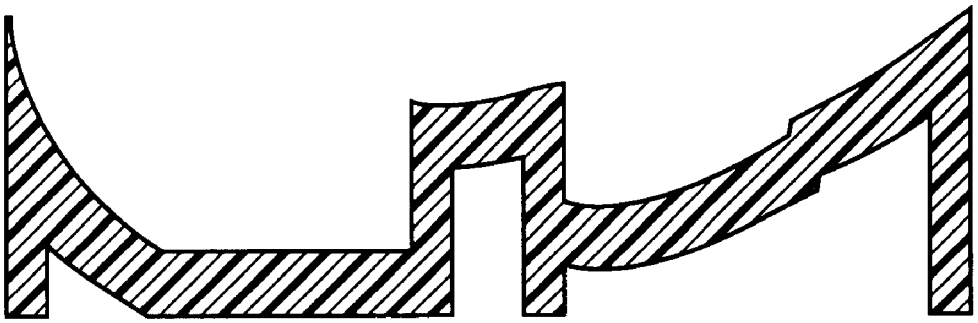
Figure 7K:
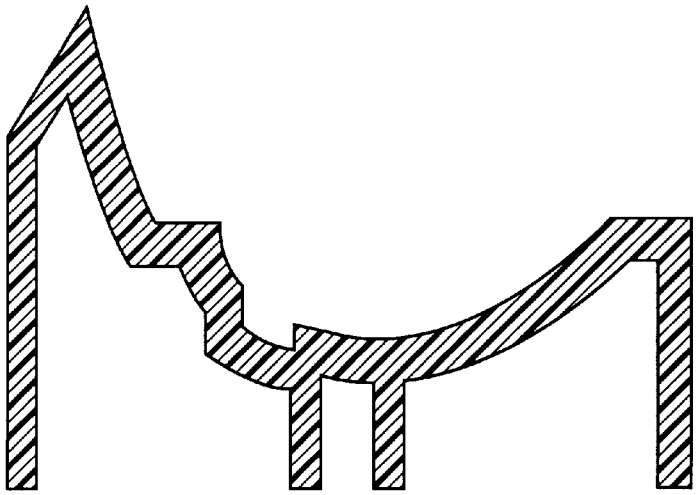

In general, the various panels are concave reflective surfaces. The curvatures of these panels are illustrated in FIGS. 6–7K. However, although the present invention is described with curved panels, it should be understood that the present invention can be modified to implement a plurality of flat panels or facets. Namely, the curvature of a panel can be approximated by implementing a plurality of slightly angled flat surfaces, to produce a similar light redirecting effect of the present invention.

Figure 8:
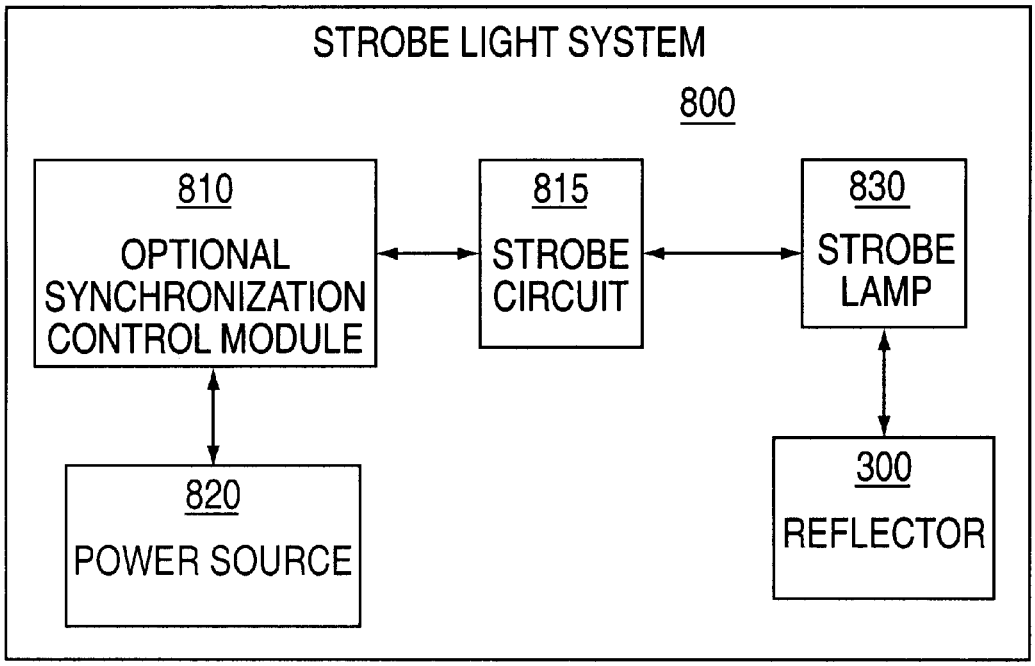
FIG. 8 depicts a block diagram of a strobe light system.

FIG. 8 depicts a block diagram of a strobe light system 800. More specifically, strobe light system 800 comprises a strobe circuit 815, an optional synchronization control module 810, a power source 820, a strobe lamp 830 and the present reflector 300. In general, strobe circuit 815 contains the necessary control circuit for causing the strobe lamp 830 to flash in a controlled manner within the present reflector 300. Optionally, strobe circuit 815 may receive inputs from a synchronization control module 810 which is employed to synchronize the flashing of a plurality of strobe lamps. Examples of such a strobe circuit and synchronization control module are provided in U.S. Pat. Nos. 5,400,009 and 5,608,375, which are owned by the assignee and are incorporated herein by reference. It should be noted that the strobe light system 800 can be implemented with other strobe circuits of different complexity.

The power source 820 may comprise a portable power source within the strobe light system 800 or it may represent a power source from a fire alarm control panel (not shown).

Although various embodiments which incorporate the teachings of the present invention have been shown and described in detail herein, those skilled in the art can readily devise many other varied embodiments that still incorporate these teachings.

What is claimed is:

1. A reflector for directing light from a strobe lamp, said reflector comprising:

a base defining a base;

a pair of spaced supports extending from said base to a reference plane parallel to the plane of said base; and a top reflective section, coupled to said base, said top reflective section having a center reflective portion extending from said base beyond said reference plane for directing the light to a range of vertical viewing angles, wherein the top reflective section produces a non-uniform illumination.

2. The reflector of claim 1, wherein said center reflective portion contains a concave reflective surface.

3. The reflector of claim 1, wherein said top reflective section further comprises a left reflective portion for directing light to a range of negative horizontal viewing angles.

4. The reflector of claim 3, wherein said top reflective section further comprises a right reflective portion for directing light to a range of positive horizontal viewing angles.

5. The reflector of claim 4, further comprising:

a bottom reflective section, coupled to said base, said bottom reflective section having a left reflective portion for directing light to a range of negative horizontal viewing angles.

6. The reflector of claim 5, wherein said bottom reflective section further comprises a right reflective portion for directing light to a range of positive horizontal viewing angles.

7. The reflector of claim 6, wherein said left reflective portion of said top reflective portion and said left reflective portion of said bottom reflective portion collectively direct light to a range of negative horizontal viewing angles between −60 degree (°) to −90 degree (°).

8. The reflector of claim 6, wherein said right reflective portion of said top reflective portion and said right reflective portion of said bottom reflective portion collectively direct light to a range of positive horizontal viewing angles between 60 degree (°) to 90 degree (°).

9. The reflector of claim 3, wherein said left reflective portion of said top reflective section comprises an upper panel and a lower panel.

10. The reflector of claim 9, wherein said upper panel of said left reflective portion of said top reflective section directs light to a range of negative horizontal viewing angles between −60 degree (°) to −70 degree (°).

11. The reflector of claim 9, wherein said lower panel of said left reflective portion of said top reflective section directs light to a range of negative horizontal viewing angles between −70 degree (°) to −80 degree (°).

12. The reflector of claim 5, wherein said left reflective portion of said bottom reflective section comprises an upper panel and a lower panel.

13. The reflector of claim 12, wherein said upper panel of said left reflective portion of said bottom reflective section directs light to a range of negative horizontal viewing angles between −70 degree (°) to −80 degree (°).

14. The reflector of claim 12, wherein said lower panel of said left reflective portion of said bottom reflective section directs light to a range of negative horizontal viewing angles between −80 degree (°) to −90 degree (°).

15. The reflector of claim 4, wherein said right reflective portion of said top reflective section comprises an upper panel and a lower panel.

16. The reflector of claim 15, wherein said upper panel of said right reflective portion of said top reflective section directs light to a range of positive horizontal viewing angles between 80 degree (°) to 90 degree (°).

17. The reflector of claim 15, wherein said lower panel of said right reflective portion of said top reflective section directs light to a range of positive horizontal viewing angles between 70 degree (°) to 80 degree (°).

18. The reflector of claim 6, wherein said right reflective portion of said bottom reflective section comprises an upper panel and a lower panel.

19. The reflector of claim 18, wherein said upper panel of said right reflective portion of said bottom reflective section directs light to a range of positive horizontal viewing angles between 70 degree (°) to 80 degree (°).

20. The reflector of claim 18, wherein said lower panel of said right reflective portion of said bottom reflective section directs light to a range of positive horizontal viewing angles between 60 degree (°) to 70 degree (°).

21. The reflector of claim 1, wherein said center reflective portion of said top reflective section also directs the light to a range of horizontal viewing angles.

22. The reflector of claim 5, wherein said bottom reflective section further comprises a center reflective portion for directing the light to a range of horizontal and vertical viewing angles.

23. A strobe light system comprising:

a strobe lamp;

a reflector, coupled to said strobe lamp, for directing light from said strobe lamp, where said reflector comprises: base defining a base; and a top reflective section, coupled to said base, said top reflective section having a center reflective portion for directing the light to a range of vertical viewing angles and producing a non-uniform illumination, said center portion extending from said base beyond a reference plane that is parallel to the plane of said base, where said reference plane shares a central axis with said strobe lamp.

* * * * *

UNITED STATES PATENT AND TRADEMARK OFFICE

CERTIFICATE OF CORRECTION

PATENT NO. : 6,217,196 B1
DATED : April 17, 2001
INVENTOR(S) : Joseph Kosich; Luy Nguyen; and David H. Strome It is certified that error appears in the above-identified patent and that said Letters Patent is hereby corrected as shown below:

Column 7, claim 1,
Line 4, change "base" (second occurrence) to -- plane --.

Column 8, claim 23,
Line 42, change "base" (second occurrence) to -- plane --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*